US005325103A

United States Patent [19]

Schuss

[11] Patent Number: 5,325,103

[45] Date of Patent: Jun. 28, 1994

[54] LIGHTWEIGHT PATCH RADIATOR ANTENNA

[75] Inventor: Jack J. Schuss, Sharon, Mass.

[73] Assignee: Raytheon Company, Lexington, Mass.

[21] Appl. No.: 972,011

[22] Filed: Nov. 5, 1992

[51] Int. Cl.[5] ..... H01Q 1/38

[52] U.S. Cl. ..... 343/700 MS; 343/705; 343/853

[58] Field of Search ..... 343/700 MS, 846, 853, 343/705, 708, 872

[56] References Cited

U.S. PATENT DOCUMENTS

| | | | |
|---|---|---|---|
| 4,477,813 | 10/1984 | Weiss | 343/700 MS |
| 4,924,236 | 5/1990 | Schuss | 343/700 MS |
| 5,008,681 | 4/1991 | Cavallaro et al. | 343/700 MS |
| 5,160,936 | 11/1992 | Braun et al. | 343/700 MS |
| 5,206,655 | 4/1993 | Caille et al. | 343/700 MS |

FOREIGN PATENT DOCUMENTS

| | | | |
|---|---|---|---|
| 0184806 | 10/1983 | Japan | 343/700 MS |
| 0010806 | 1/1985 | Japan | 343/700 MS |
| 0046804 | 2/1988 | Japan | H01Q 1/38 |

*Primary Examiner*—Donald Hajec
*Assistant Examiner*—Tan Ho
*Attorney, Agent, or Firm*—Walter F. Dawson; Richard M. Sharkansky

[57] ABSTRACT

A lightweight patch radiator phased array antenna having a single layer patch construction on an artificial dielectric, such as syntactic foam, which achieves a factor-of-ten weight savings over an array constructed with conventional materials. An additional sixty-five percent weight reduction is achieved by cutting away the dielectric material down to the array antenna's ground plane everywhere except under the patch radiator. This construction allows placement of a thermal control material over the patch and ground plane for space applications.

20 Claims, 4 Drawing Sheets

LIGHTWEIGHT PATCH RADIATOR ANTENNA

BACKGROUND OF THE INVENTION

This invention relates generally to antennas and in particular to a lightweight patch radiator antenna for use in an airborne or spaceborne phased array antenna.

It is known in the art that a patch radiator consists of a conductive plate, or patch,. separated from a ground plane by a dielectric medium. When an RF current is conducted within the cavity formed between the patch and its ground plane, an electric field is excited between the two conductive surfaces. It is the ,fringe field, at the outer edges of the patch, that launches the useable electromagnetic waves into free space.

Patch elements are advantageous in phased arrays because they are compact, they can be integrated into a microwave array very conveniently, they support a variety of feed configurations, and they are capable of generating circular polarization. They also have the advantage of cost effective printed circuit manufacture of large arrays of elements.

For some applications a major drawback to the use of phased array antenna systems is their high cost because of the need for hundreds or thousands of antenna elements and associated transmit/receive circuitry. For other applications such as a spaceborne application, weight is a critical factor. Prior art materials used in patch radiator antennas, having a dielectric constant of approximately 2 such as a Teflon-fiberglass material known as Duroid 5880, may result in a considerable weight contribution to the total weight of an antenna depending on its size. Duroid is a registered trademark of Rogers Corporation of Chandler, Arizona. A patch radiator antenna using Duroid material is described in U.S. Pat. No. 5,008,681, "Microstrip Antenna with Parasitic Elements," issued to Nunzio M. Cavallaro et al., and assigned to Raytheon Company of Lexington, Massachusetts. The present invention of a lightweight patch radiator antenna reduces the weight drawback and thermal control considerations related to the array antenna surface coatings in spaceborne applications.

SUMMARY OF THE INVENTION

It is therefore an object of the present invention to provide a lightweight patch radiator antenna for space applications.

It is a further object of this invention to provide a lightweight phased array antenna for space applications.

These objects are generally attained by selectively reducing the quantity of dielectric material used in the antenna and by the use of an artificial dielectric such as syntactic foam.

The objects are further accomplished by providing a patch radiator antenna comprising an antenna panel having a ground plane, a thermal control material bonded to the ground plane surface of the antenna panel, a plurality of patch radiators arranged on the antenna panel in a spaced apart manner with no dielectric material between the patch radiators, each of the plurality of patch radiators comprising a dielectric means having a first surface and a second surface, a patch element disposed on and bonded to the first surface of the dielectric means, a flange bonded to the second surface of the dielectric means, thermal control material bonded to the patch element, and probe means extending from the patch radiator for coupling the patch element to an RF signal source. The antenna panel comprises an aluminum honeycomb material. The dielectric means comprises a low weight, high dielectric, syntactic foam. The thermal control material comprises a flexible optical solar reflector or a thermal control paint.

The objects are further accomplished by providing a phased array antenna comprising an antenna panel having a ground plane, a thermal control material bonded to the ground plane surface of the antenna panel, a plurality of patch radiators arranged on the antenna panel in a spaced apart manner with no dielectric material between the patch radiators, a transmit/receive (T/R) module coupled to each of the plurality of patch radiators, each of the plurality of patch radiators comprising a dielectric means having a first surface and a second surface, a patch element disposed on and bonded to the first surface of the dielectric means, a flange bonded to the second surface of the dielectric means, thermal control material bonded to the patch element, and probe means extending from the patch radiator for coupling the patch element to the T/R module. The antenna panel comprises an aluminum honeycomb material. The dielectric means comprises a low weight, high dielectric, syntactic foam. The thermal control material comprises a flexible optical solar reflector or a thermal control paint.

The objects are further accomplished by a method for providing a lightweight patch radiator antenna comprising the steps of providing an antenna panel having a ground plane, bonding to the ground plane surface of the antenna panel a thermal control material, arranging on the antenna panel in a spaced apart manner a plurality of patch radiators with no dielectric material between the patch radiators, providing a dielectric means having a first surface and a second surface for each of the plurality of patch radiators, disposing a patch element on and bonding it to the first surface of the dielectric means, bonding a flange to the second surface of the dielectric means, bonding thermal control material to the patch element, and coupling the patch element to an RF signal source with probe means extending from the patch radiator. The step of providing a thermal control material comprises bonding a flexible optical solar reflector.

The objects are further accomplished by a method for providing a phased array antenna comprising the steps of providing an antenna panel having a ground plane, bonding to the ground plane surface of the antenna panel a thermal control material, arranging on the antenna panel in a spaced apart manner a plurality of patch radiators with no dielectric material between the patch radiators, coupling a transmit/receive (T/R) module to each of the plurality of patch radiators, providing a dielectric means having a first surface and a second surface for each of the plurality of patch radiators, disposing a patch element on and bonding it to the first surface of the dielectric means, bonding a flange to the second surface of the dielectric means, bonding thermal control material to the patch element, and coupling the patch element to the T/R module with probe means extending from the patch radiator. The step of providing an antenna panel comprises the panel having an aluminum honeycomb material. The step of providing a dielectric means includes the dielectric means comprising a low weight, high dielectric, syntactic foam. The step of providing a thermal control material comprises bonding a flexible optical solar reflector.

BRIEF DESCRIPTION OF THE DRAWINGS

Other and further features of the invention will become apparent in connection with the accompanying drawings wherein.

DESCRIPTION OF THE PREFERRED EMBODIMENT

Figure 1:
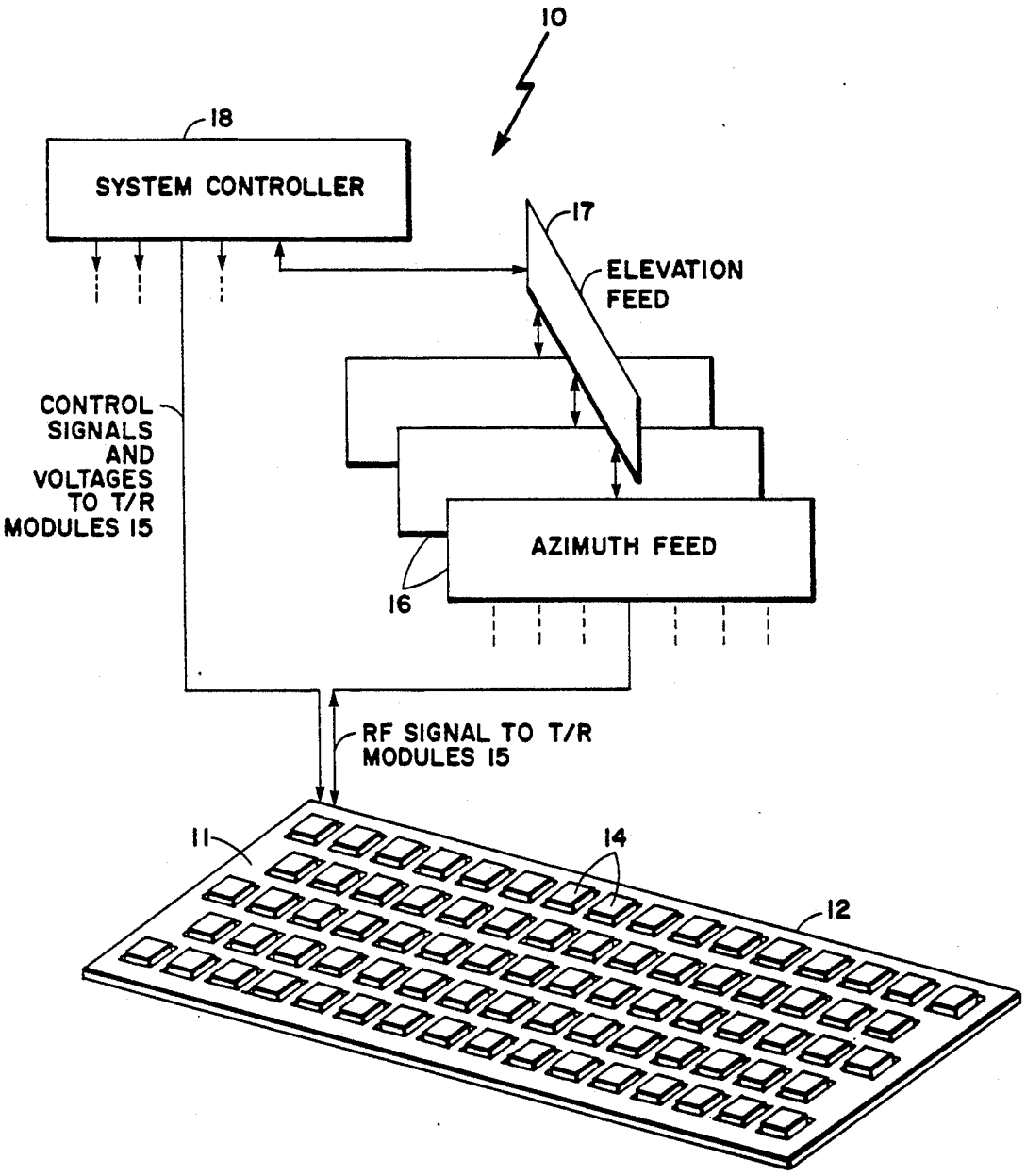
FIG. 1 is a simplified sketch of a phased array antenna comprising a plurality of patch radiators coupled to apparatus for generating RF signals.

Referring initially to FIG. 1, it may be seen that a lightweight phased array antenna 10 according to the present invention includes a plurality of patch radiators 14 mounted on a top surface 11 of an antenna panel 12 with no dielectric material between each of the patch radiators. Each patch radiator 14 is fed by a corresponding transmit/receive (T/R) module 15 (shown in FIG. 2) attached to the inner side of the patch radiator 14 opposite surface 11. T/R modules 15 are driven by an RF feed network of RF power dividers 16, 17 which provide RF signals to each of the T/R modules 15; phase information is supplied to each T/R module 15 through the system controller 18. System controller 18 originates the RF feed signals to power dividers 16, 17 as well as control signals and voltages to the plurality of T/R modules 15. The phased array antenna 10 operates in the L-band frequency range (1-2 GHz).

Figure 2:
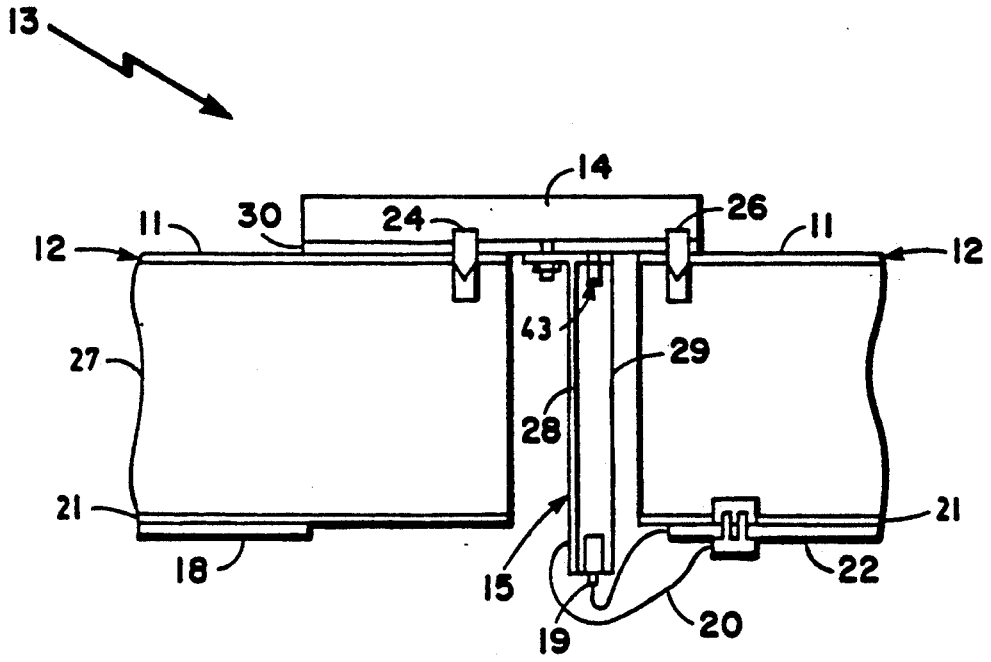
FIG. 2 is an end view of a patch radiator antennule module plugged into an antenna panel showing a T/R module attached to a patch radiator.

Referring now to FIG. 2, an end view of an antennule module 13 is shown which is positioned by pins 24, 26 into the side 11 of the antenna panel 12. The antennule module 13 comprises the single layer radiator patch 14 and the T/R module 15 with the T/R module 15 being attached to the bottom side of the patch radiator 14 which touches the surface 11 of antenna panel 12. At one end of the T/R module 15 is a coaxial RF connector 19 and a flexible circuit cable 20 which are provided for electrically connecting the T/R module 15 to a wiring board 22 disposed on a bottom surface 21 of antenna panel 12. At the other end of the T/R module 15 which attaches to the patch radiator 14 two inserts 43 are provided for insertion of two probes 42 extending from the patch radiator 14. By attaching directly to the T/R module 15 an intermediate connector is not used, and the reliability of the antennule module 13 comprising patch radiator 14 and T/R module 15 is improved. The antenna panel 12 which functions as a ground plane comprises an aluminum honeycomb material 27 of approximately 1.5 inches thickness to accommodate acoustic loading during a launch in the space application for the present embodiment. The T/R module 15 comprises a baseplate 28 and a cover 29. The antennule module 13 provides for minimal cost to manufacture and maintain such a phased array antenna 10.

It should be noted that the preferred embodiment of the invention shown in FIG. 2 shows a T/R module 15 driving the patch radiator 14. However, in some applications this may not be necessary when beam scanning is not required resulting in an embodiment comprising the RF feed apparatus 16, 17 of FIG. 1 directly feeding the patch radiators 14. Depending on the nature of the RF feed, one or several fixed beams could then be radiated by the array of patch radiators 14. However, eliminating the T/R module 15 removes the capability of electronically scanning or changing these beams.

Figure 3:
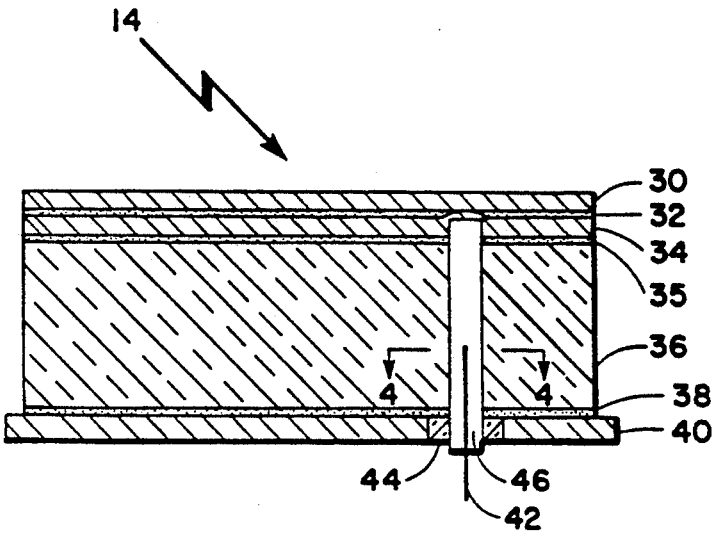
FIG. 3 is a cross-section of the patch radiator according to the invention.
Figure 4:
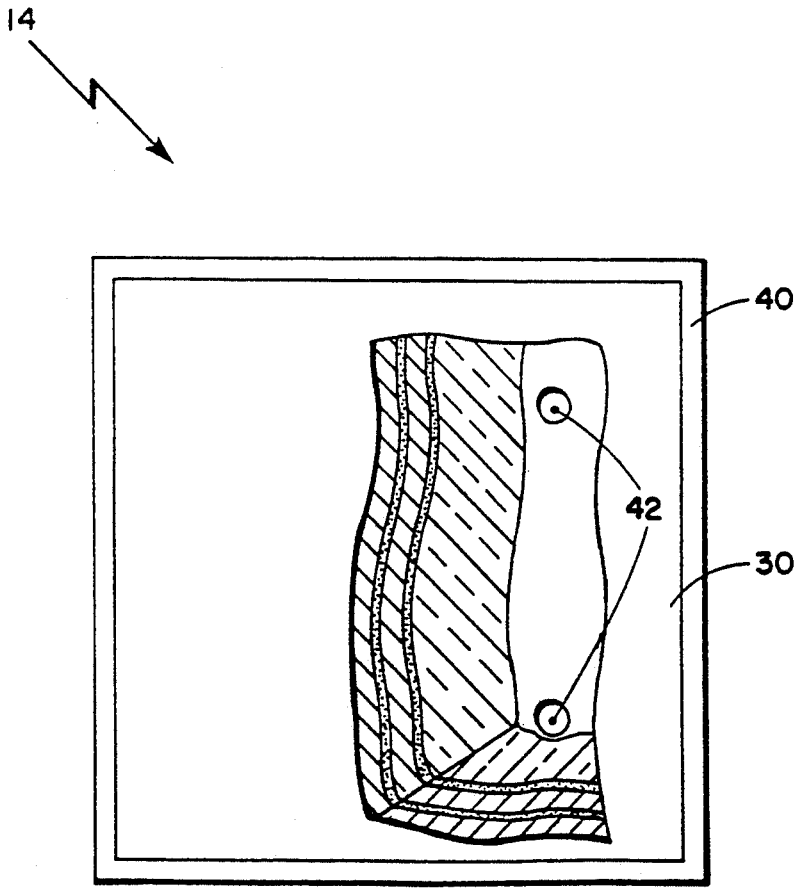
FIG. 4 is a plan view of the FIG. 3 embodiment with a portion of the patch radiator cut away to a level exposing two probe pins for making an RF connection to a T/R module.

Referring now to FIG. 3 and FIG. 4., there is shown in FIG. 3 a cross-sectional view of the patch radiator 14 according to the invention. A patch element 34 comprising an electrically conducting material such as copper is attached to a first side of a dielectric material 36 with a bonding material 35. The dielectric material 36 in the present embodiment is low weight, high dielectric, syntactic foam. A second side of the dielectric material is bonded with a pressure sensitive bonding film 38 to an aluminum flange 40. A cylinder of conductive material 46 extends from the patch element 34, to which it is electrically attached or soldered, through the dielectric material 36 and an insulator 44 in the aluminum flange 40, and contained within and extending from the cylinder 46 is a conductive probe pin 42 for insertion into the T/R module 15. As shown in FIG. 4, which is a plan view of the patch radiator 14 having a portion cut away, there are two probe pins 42 extending from the patch radiator 14, one for each of the circular polarization RF signals. On top of the patch element 34 is a layer of a thermal control material 30 such as a thermal flexible optical solar reflector (FOSR); it is attached to the patch element 34 with a pressure sensitive bonding film 32. Because there is no dielectric material on the antenna panel 12 except within each patch radiator 14, FOSR is useable for thermal control over the patch radiator 14 and the ground plane which is surface 11 of antenna panel 12. As an alternative to. FOSR, a thermal control paint may be used depending on application requirements.

The two probes 42 of each patch radiator 14 are fed 90 degrees out of phase with RF voltages of approximately equal amplitude. These probes 42 can be located on the diagonals of the square patch, as shown in FIG. 4, or located on the principal axes of the patch; another variation comprises the use of around patch radiator, with the probes located at equal distances from the patch. In all configurations the probes are located equal distances from a patch radiator center, and angularly displaced 90 degrees relative to each other as measured from the center of the patch reference. Either right handed or left handed waves can be radiated by this array by choosing either a +90 degree or a −90 degree relative phasing of the 2 probes. The RF drive voltages to the patch radiator probes 42 are supplied by the T/R module 15, which comprises a 90 degree phase shift network at its output; the T/R module 15 may also contain an auxiliary patch radiator matching network, if desired. Alternately, such phase shift and matching networks can be provided by the RF feed apparatus 16, 17 for the configuration noted hereinbefore having the T/R modules eliminated. The result is that in all configurations, each patch radiator 14 in an antenna array is driven at the desired voltage amplitude and phase with its probes 42 phased 90 degrees with respect to one another.

Another variation of this invention has only one probe driving the patch radiator 42. In this case the 90 degree phase shift network of the T/R module 15 is eliminated, and the T/R module output voltage directly feeds the probe 42. Such an antenna array functions identically to the array described above, except that it radiates a linearly polarized beam.

Referring again to FIG. 1 and FIG. 3, a 30 times (30 X) reduction in weight of the antenna panel 12 is achieved with the present invention. Part of this weight savings is obtained by cutting away all dielectric material on the array top surface 11 (approximately 65%) except for where it is needed underneath the patch element 34 of the patch radiator 14. This approach has the further advantage of allowing the placement of the thermal control material 30 on the array ground plane or panel 12, thereby improving thermal performance. Since the patch radiator 14 only covers approximately 35% of the antenna panel 12 surface area, this results in a 3 times reduction in the dielectric which is virtually the entire patch radiator 14 weight above the surface of the panel 12. The use of syntactic foam artificial dielectric 36 for the patch radiator substrates results in less weight by a factor of 10 compared to the prior art teflon-based dielectrics such as Duroid. This results in a total of $3\times10$ or a 30 X weight reduction in the patch radiator 14. Such weight reductions are critical for cost-effective space applications.

The dielectric material 36 may be embodied by a low weight, high dielectric constant, syntactic foam such as those manufactured by Emerson and Cumming of Canton, Massachusetts or by APTEK Corporation of Valencia, California. The bonding film 32, 35, 38 may be embodied with FM 73 manufactured by American Cyanamid of Havre de Grace, Maryland. The thermal control material, FOSR, is manufactured by Sheldahl Corporation of Northfield, Minnesota. Alternatively, a thermal control paint may be embodied by S13GLO manufactured by IIT Research Institute of Chicago, Illinois.

Figure 5:
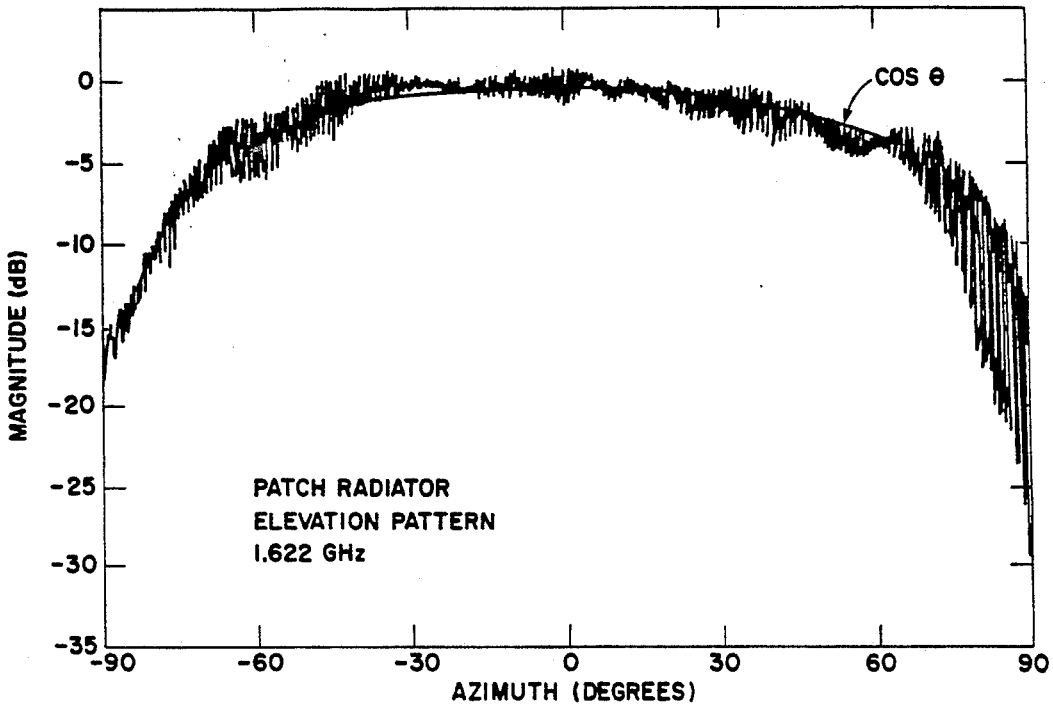
FIG. 5 is a graph of a patch radiator elevation signal at 1.622 GHz taken when embedded in a phased array of attenuated elements.
Figure 6:
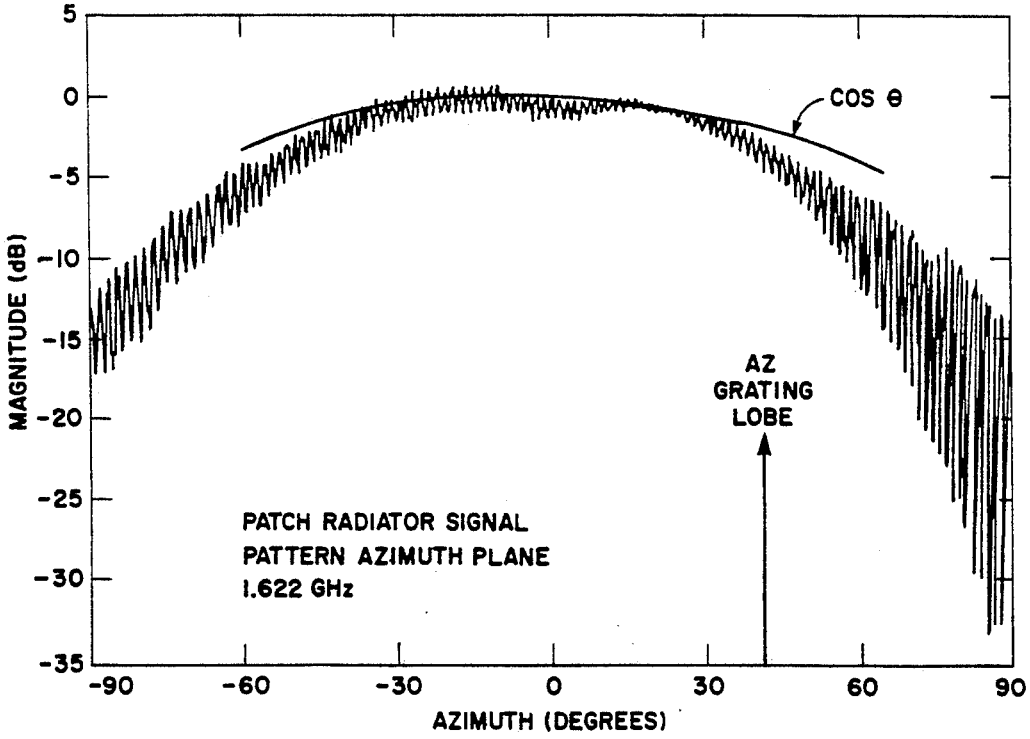
FIG. 6 is a graph of the patch radiator signal at 1.622 GHz in the azimuth plane.

Referring now to FIG. 5 and FIG. 6, FIG. 5 shows the patch radiator 14 elevation radiating pattern at 1.622 GHz compared relative to the ideal cos $\theta$ pattern (solid line) and FIG. 6 shows the patch radiator 14 azimuth radiating pattern at 1.622 GHz compared to the ideal cos $\theta$ pattern (solid line). The benefits of the present invention are primarily realized in the frequency ranges of L-band or S-band. When the operating frequency is below 4 GHz the patch radiator 14 size and weight savings are significant. The present invention achieved a major weight decease in the L-band phased array antenna 10 operation whereas at higher frequencies less weight savings are achieved.

The patterns shown in FIGS. 5 and 6 are significant in that they demonstrate the proper operation of the patch radiator of the present invention. An ideal patch radiator, when excited by an RF drive signal and with all other radiators terminated in their usual output impedance, exhibits a cos $\theta$ radiated power pattern in all planes. FIGS. 5 and 6 show the corresponding elevation plane and azimuth plane radiated power patterns of the patch radiator of this invention, taken in a small array with all other patch radiators resistively terminated. The driven patch radiator probes 42 are fed 90 degrees out of phase, resulting in a circular polarization of the radiated wave. The measurement is taken by a rapidly rotating linearly polarized horn (as is customary practice) located in the far field whose angular location relative to the array is slowly varied to measure the appropriate radiated field pattern. The closely spaced peaks and minima of the patterns of FIGS. 5 and 6 show the major and minor axes of the polarization elipse, whereas the slower variations show the pattern variation with angular position of the far field horn. The difference in decibels between the successive maxima and minima of this pattern represents the local axial ratio of the array at that radiation angle. From FIGS. 5 and 6 it can be seen that the patterns exhibit nearly cos $\theta$ variations with radiated angle and axial ratios of approximately 1 db over most of the scan volume. The radiated power of the azimuth pattern only falls off near the azimuth grating lobe onset location, as expected. This azimuth grating lobe onset location is set by the azimuth spacing of the radiators in the array, and is closer in angle to boresight than the elevation plane grating lobe onset angle. These patterns demonstrate the proper operation of the patch radiator invention described herein.

This concludes the description of the preferred embodiment. However, many modifications and alterations will be obvious to one of ordinary skill in the art, such as the type of thermal control material 30 to be used in a particular application, without departing from the spirit and scope of the inventive concept. Therefore, it is intended that the scope of this invention be limited only by the appended claims.

What is claimed is:

1. A patch radiator antenna comprising:

an antenna panel, said panel providing a ground plane;

a first thermal control material means bonded to said ground plane surface of said antenna panel;

a plurality of patch radiators arranged on said antenna panel in a spaced apart manner with no solid dielectric material between said patch radiators;

each of said plurality of patch radiators comprising:

(a) a dielectric means having a first surface and a second surface;

(b) a patch element disposed on and bonded to said first surface of said dielectric means;

(c) a flange bonded to said second surface of said dielectric means;

(d) a second thermal control material means bonded to said patch element; and (e) probe means extending from said patch radiator for coupling said patch element to an RF signal source.

2. The patch radiator antenna as recited in claim 1 wherein:

said antenna panel comprises an aluminum honeycomb material means.

3. The patch radiator antenna as recited in claim 1 wherein:

said dielectric means comprises a low weight, high dielectric, syntactic foam.

4. The patch radiator antenna as recited in claim 1 wherein:

said thermal control material means comprises a flexible optical solar reflector.

5. The patch radiator antenna as recited in claim 1 wherein:

said thermal control material comprises a thermal control paint.

6. A phased array antenna comprising:

an antenna panel, aid panel providing a ground plane;

a first thermal control means bonded to said ground plane surface of said antenna panel;

a plurality of patch radiators arranged on said antenna panel in a spaced apart manner with no solid dielectric material between said patch radiators;

a transmit/receive (T/R) module coupled to each of said plurality of patch radiators;

each of said y of patch radiators comprising:

(a) a dielectric having a first surface and a second surface;

(b) a patch disposed on and bonded to said first surface of said dielectric means;

(c) a flange bonded to said second surface of said dielectric means;

(d) a second thermal control material means bonded to said patch element; and (e) probe means extending from said patch radiator for coupling said patch element to said T/R module.

7. The phased array antenna as recited in claim 6 wherein:

said antenna panel comprises an aluminum honeycomb material means.

8. The phased array antenna as recited in claim 6 wherein:

said dielectric means comprises a low weight, high dielectric, syntactic foam.

9. The phased array antenna as recited in claim 6 wherein:

said thermal control material means comprises a flexible optical solar reflector.

10. The phased array antenna as recited in claim 6 wherein:

said thermal control material comprises a thermal control paint.

11. A method for providing a lightweight patch radiator antenna comprising the steps of:

providing an antenna panel having a ground plane;

bonding to said ground plane surface of said antenna panel a first thermal control material means;

arranging on said antenna panel in a spaced apart manner a plurality of patch radiators with no solid dielectric material between said patch radiators;

providing a dielectric means having a first surface and a second surface for each of said plurality of patch radiators;

disposing a patch element on and bonding it to said first surface of said dielectric means;

bonding a flange to said second surface of said dielectric means;

bonding a second thermal control material means to said patch element; and coupling said patch element to an RF signal source with probe means extending from said patch radiator.

12. The method as recited in claim 11 wherein:

said step of providing an antenna panel comprises said panel having an aluminum honeycomb material means.

13. The method as recited in claim 11 wherein said step of providing a dielectric means includes said dielectric means comprising a low weight, high dielectric, syntactic foam.

14. The method as recited in claim 11 wherein:

said step of providing a thermal control material means comprises bonding a flexible optical solar reflector.

15. The method as recited in claim 11 wherein:

said step of providing thermal control material means comprises a thermal control paint.

16. A method for providing a phased array antenna comprising the steps of:

providing an panel having a ground plane;

bonding to s ground plane surface of said antenna panel a first thermal control material means;

arranging on said antenna panel in a spaced apart manner a plurality of patch radiators with no solid dielectric material between said patch radiators;

coupling a transmit/receive (T/R) module to each of said plurality of patch radiators;

providing a dielectric means having a first surface and a second surface for each of said plurality of patch radiators;

disposing a patch element on and bonding it to said first surface of said dielectric means;

bonding a flange to said second surface of said dielectric means;

bonding a second thermal control material means to said patch element; and coupling said patch element to said T/R module with probe means extending from said patch radiator.

17. The method as recited in claim 16 wherein:

said step of providing an antenna panel comprises said panel having an aluminum honeycomb material means.

18. The method as recited in claim 16 wherein said step of providing a dielectric means includes said dielectric means comprising a low weight, high dielectric, syntactic foam.

19. The method as recited in claim 16 wherein:

said step of providing a thermal control material means comprises bonding a flexible optical solar reflector.

20. The method as recited in claim 16 wherein:

said step of providing thermal control material means comprises a thermal control paint.

* * * * *